US008309177B2

(12) United States Patent
Cape

(10) Patent No.: US 8,309,177 B2
(45) Date of Patent: Nov. 13, 2012

(54) METHOD FOR TREATMENT OF CHEMICALLY PASSIVATED GALVANIZED SURFACES TO IMPROVE PAINT ADHESION

(75) Inventor: Thomas W. Cape, West Bloomfield, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 964 days.

(21) Appl. No.: 11/453,963

(22) Filed: Jun. 14, 2006

(65) Prior Publication Data

US 2006/0289089 A1 Dec. 28, 2006

Related U.S. Application Data

(60) Provisional application No. 60/690,246, filed on Jun. 14, 2005.

(51) Int. Cl.
*C23C 22/24* (2006.01)

(52) U.S. Cl. ..... 427/327; 148/95

(58) Field of Classification Search ..... 427/327; 148/95

See application file for complete search history.

(56) References Cited

U.S. PATENT DOCUMENTS

| | | | | |
|---|---|---|---|---|
| 3,620,949 | A * | 11/1971 | Morrison et al. | 204/486 |
| 4,548,868 | A | 10/1985 | Yonezawa et al. | |
| 5,344,504 | A * | 9/1994 | Deck et al. | 148/243 |
| 5,958,511 | A | 9/1999 | Dolan | |

FOREIGN PATENT DOCUMENTS

| | | |
|---|---|---|
| WO | WO85/05131 | 11/1985 |
| WO | WO98/47631 | 10/1998 |

* cited by examiner

*Primary Examiner* — Timothy Meeks
*Assistant Examiner* — Nathan T Leong
(74) *Attorney, Agent, or Firm* — Mary K. Cameron

(57) ABSTRACT

A method of treating a zinc-galvanized metal surface, which has been chemically passivated, the treatment providing increased resistance to corrosion and improved adherence to a subsequently applied organic coating comprising contacting a chromium passivated, zinc-galvanized metal surface with a coating solution bath comprising from about 1 to about 10 parts per thousand, based on fluorine content, of an inorganic acid or ion that contains fluorine; at least 0.5 parts per thousand, based on transition metal cation content, of an oxide and/or a salt of nickel; and optionally, from about 0 to about 3.0 grams per liter of a polymer selected from the group consisting of polyacrylic acid, polymethacrylic acid, and $C_1$ to $C_8$ alkanol esters thereof; wherein the pH of the solution is from about 2.0 to 3.6 and the temperature of the solution is at least 60° C.; and thereafter sealing the treated surface.

19 Claims, No Drawings

METHOD FOR TREATMENT OF CHEMICALLY PASSIVATED GALVANIZED SURFACES TO IMPROVE PAINT ADHESION

CROSS-REFERENCE

This invention claims priority from Provisional Application 60/690,246 filed Jun. 14, 2005.

FIELD OF THE INVENTION

This invention relates to the treatment of metals, and more particularly to the treatment of a zinciferous surface, such as zinc, zinc alloys, galvanized iron, galvanized steel, Galvalume® and the like, which has been chemically passivated with a chromium-containing passivate to provide good adhesion of subsequently applied organic coatings.

BACKGROUND OF THE INVENTION

In the steel and aluminum milling industry, galvanized iron, galvanized steel and Galvalume® articles are generally treated with a chemical passivating rinse shortly after galvanization in order to prevent corrosion during storage and shipping. Chemical passivating rinses are known in the art and may contain chromium, phosphates, polymeric materials, surfactants and other additives designed to prevent oxidation and/or hydrolysis of the zinciferous metal surfaces of the article. To date the most effective anti-corrosion passivates have been those containing chromium. The majority of galvanized metal that is transported via oceangoing vessels is passivated with a chromium-containing composition as protection against potential exposure to salt water.

The chromium-containing passivates have the drawback of providing poor adhesion of subsequently applied organic coatings applied directly to the passivated surface. This problem has been recognized in the industry for years and no commercially viable solution has previously been found. The durability of the chromium-containing passivate on zinc surfaces increases the difficulty of removing the passivate when subsequent painting is desired. Thus, there is a need for a treatment for zinc-galvanized metals, such as galvanized iron, galvanized steel and Galvalume® articles, which have been chemically treated with a chromium-containing passivate, that improves adhesion of subsequently applied organic coatings, such as paint, lacquer and the like, that can be applied to the article without first removing all or substantially all of the passivate.

The excellent corrosion resistance and poor paint adherence features of chromium-containing passivates have caused some steel and aluminum mills to generate two product streams, one intended for later painting which is not treated with chromium-containing passivate and another, not intended to be painted, that is treated with chromium-containing passivate. The two product streams have resulted in duplicate inventories and other inefficiencies in the industry. Typical chromium-containing passivates are not easily detectable by the human eye, which has resulted in the shipment of the wrong product to customers. The industry has resorted to test procedures to determine whether a metal panel has been passivated using chromium. Shipping errors and testing to verify the absence of chromium-containing passivate are a cost to the manufacturer and customer. Thus, there is a need for a treatment for chemically passivated zinciferous metal surfaces, to improve adhesion of subsequently applied organic coatings, such as paint, lacquer and the like, which would enable the steel and aluminum mills to use a chromium-containing passivate for all galvanized products (intended to be painted or to remain unpainted), thus eliminating dual inventories and product testing of the passivated surface to determine whether a chromium containing passivate is present.

It is known to coat unpassivated or non-chrome passivated zinc surfaces of galvanized metals with aqueous coating solutions that are effective in providing corrosion resistant coatings. In addition to serving to prevent or inhibit corrosion, such coatings may also increase the adhesion properties of the surface to organic coatings such as paints, lacquers and the like, which may be subsequently applied to the metal. A general type of treatment composition for inhibiting corrosion and increasing adhesion of siccative coatings is disclosed in WO/85/05 131, in which the zinc surface after cleaning and rinsing, is coated with the composition, rinsed with water and lastly, rinsed with a chrome containing passivate. U.S. Pat. No. 5,344,504 to Deck et al. teaches compositions of: a fluorometallic acid, a transition metal salt, and zinc. In the process for applying these coatings a zinc surface, e.g. galvanized, is cleaned using an alkaline cleaner, rinsed with water, coated with the coating solution, rinsed with water, and then rinsed with an acidulated chrome solution. A siccative coating can thereafter be applied to the metal. This process has the drawback of requiring operation in a very narrow pH range of between 4 and 5. None of the aforementioned publications address the unique problem posed by the need to paint zinciferous metal surfaces that have already been chromium passivated. Thus there remains a need for a process of treating chromium passivated, zinciferous metal surfaces which provides increased resistance to corrosion and improved adherence of a subsequently applied organic coating. No commercially available products provide sufficient paint adhesion and corrosion protection to meet manufacturers' requirements.

SUMMARY OF THE INVENTION

A major object of the present invention is to provide an improved process for treating chemically passivated, zinciferous surfaces with compositions containing transition metal cations and fluorometallate anions to provide a paintable surface, improve paint adherence to the surface and minimize variations in the quality of the protective coatings formed thereby. Other objects will be apparent from the description below.

The instant invention is directed to a method of treating a zinc-galvanized metal surface, which has been chemically passivated, the treatment providing increased resistance to corrosion and improved adherence to a subsequently applied organic coating comprising: contacting a chromium passivated, zinc-galvanized metal surface with a coating solution bath comprising: from about 1 to about 10 parts per thousand, based on fluorine content, of an inorganic acid or ion that contains fluorine; at least 0.5 parts per thousand, based on transition metal cation content, of an oxide and/or a salt of nickel; and optionally, from about 0 to about 3.0 grams per liter of a polymer selected from the group consisting of polyacrylic acid, polymethacrylic acid, and $C_1$ to $C_8$ alkanol esters thereof; wherein the pH of the solution is from about 2.0 to 3.6, preferably from about 2.4 to 3.5 and the temperature of the solution is at least 60° C., preferably from 60° C. to about 90° C.; and thereafter sealing the treated surface.

Desirably, the inorganic acid or ion that contains fluorine is selected from the group consisting of HF, $HBF_4$, $H_2SiF_6$, $H_2TiF_6$, $H_2ZrF_6$, $F^-$, $BF_4^-$, $SiF_6^{-2}$, $TiF_6^{-2}$, $ZrF_6^{-2}$ and mixtures thereof, preferably from the group consisting of HF, $H_2SiF_6$, $F^-$, $SiF_6^{-2}$ and mixtures thereof. It is preferred that the inorganic acid or ion that contains fluorine is present in an amount from about 1.3 to about 8 parts per thousand.

It is also desirable that anions of the nickel salt are selected from the group consisting of carbonate, sulfate, phosphate, acetate, nitrate, $F^-$, $BF_4^-$, $SiF_6^{-2}$, $TiF_6^{-2}$, $ZrF_6^{-2}$ and mixtures thereof, preferably the anions are carbonate and/or phosphate. Preferably, the oxide and/or salt of nickel is present in an amount from about 0.5 to about 10 parts per thousand, based on nickel content.

In a preferred embodiment, the inorganic acid or ion that contains fluorine is present in an amount from about 1.5 to about 7 parts per thousand and the oxide and/or salt of nickel is present in an amount from about 0.5 to about 5 parts per thousand based on nickel content.

It is another object of the invention to provide a method of treating a surface on a metal article, having at least one surface comprising an amorphous mixture of zinc phosphate, zinc chromate, chromic chromates, chromium phosphate, and chromium oxides, the treatment providing increased resistance to corrosion and improved adherence to a subsequently applied organic coating comprising:

contacting the metal article having at least one surface comprising an amorphous mixture of zinc phosphate, zinc chromate, chromic chromates, chromium phosphate, and chromium oxides with a coating solution bath of the invention wherein the pH of the solution is from about 2.0 to 3.6 and the temperature of the solution is at least 60° C.;

sealing the treated surface; and optionally, painting the sealed treated surface.

It is another object of the invention to provide a method of treating an article, having at least one zinc-galvanized metal surface which has been chemically passivated, the treatment providing increased resistance to corrosion and improved adherence to a subsequently applied organic coating comprising:

cleaning the chromium passivated, zinc-galvanized metal surface of the article;

contacting the cleaned chromium passivated, zinc-galvanized metal surface with a coating solution bath of the invention;

rinsing the coated surface with water;

contacting the coated surface with a sealing rinse; and drying the coated sealed surface.

Desirably, the cleaning step comprises physical abrasion of the chromium passivated, zinc-galvanized metal surface such that at least some chromium from the chromium passivation remains on the metal surface.

It is another object of the invention to provide articles comprising: a metal surface comprising at least 50% by weight zinc; an amorphous layer comprising a mixture of zinc chromate, chromic chromates, and chromium oxides deposited on said metal surface; an anticorrosion coating deposited on said amorphous layer, comprising reaction products of said amorphous layer, an inorganic acid or ion that contains fluorine and nickel cations, said reaction products comprising at least nickel metal and nickel oxides; a sealant layer and optionally a paint layer. In one embodiment the amorphous layer and/or the anticorrosion coating further comprise metal phosphates. It is yet another object of the invention to provide articles made according to the processes of the invention.

Except in the claims and the specific examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the term "polymer" includes "oligomer", "copolymer", "terpolymer", and the like; the first definition or description of the meaning of a word, phrase, acronym, abbreviation or the like applies to all subsequent uses of the same word, phrase, acronym, abbreviation or the like and applies, mutatis mutandis, to normal grammatical variations thereof; the description of a group or class of materials as suitable or preferred for a given purpose in connection with the invention implies that mixtures of any two or more of the members of the group or class are equally suitable or preferred; chemical descriptions of neutral materials apply to the materials at the time of addition to any combination specified in the description and/or of generation in situ in a combination by chemical reactions described in the specification, and do not necessarily preclude chemical changes to the materials as a result of unstated reaction in the combination; specification of materials in ionic form means that the materials are supplied to prepare the compositions containing them in the form of soluble substance(s) containing the ions specified and implies the presence in any composition specified to contain ionic materials of sufficient counterions to produce electrical neutrality for the composition as a whole; any counterions thus implicitly specified preferably are selected from among other constituents explicitly specified in ionic form, to the extent possible; otherwise such counterions may be freely selected, except for avoiding counterions that act adversely to an object of the invention.

Other than in the operating examples, or where otherwise indicated, all numbers expressing quantities of ingredients, reaction conditions, or defining ingredient parameters used herein are to be understood as modified in all instances by the term "about". Unless otherwise indicated, all parts are parts by weight and percentages are percent by weight.

DETAILED DESCRIPTION OF A PREFERRED EMBODIMENT

This invention relates to processing articles having zinciferous metal surfaces, i.e., surfaces of a metallic material that is at least 55% by weight zinc, which have been passivated using a chromium-containing composition, to improve the adhesion of organic coatings to the surface. The processing includes contacting the chromium-passivated zinciferous surfaces with an aqueous acidic treatment composition containing transition metal cations and fluorine containing anions at a selected pH.

The passivated zinc surface may be galvanized iron, galvanized steel, Galvalume® and the like. The chromium passivated zinciferous surfaces are markedly different from non-passivated zinciferous surfaces typically used in industries that require painting of the zinciferous surfaces. The two types of surfaces show different results in corrosion resistance, paint adherence and composition. The typical chemical composition of non-passivated zinciferous surfaces comprises a mixture of zinc metal and any alloy metals, such as aluminum, together with oxides of these metals. Surfaces passivated with a non-chromium passivate have outer surfaces with a chemical composition including zinc phosphate, zinc oxide, and other metal oxides and mixtures thereof. Chromium passivated surfaces have a different chemical composition, which results in poor paint adhesion, but good corrosion resistance. It is known in the art that chromium passivated zinciferous surfaces typically have a chemical composition comprising an amorphous mixture of zinc phosphate, zinc chromate, chromic chromates, chromium phosphate, and chromium oxides, as well as hydrated variants and hydroxides thereof. Without being bound by a single theory, it is believed that the differences between zinciferous surfaces passivated with a chromium-containing composition and other zinciferous surfaces relate to the structure of the surface, as well as the chemical composition thereof and that the process described herein causes a structural rearrangement of the surface, in addition to a change in the chemical composition, that results in improved adherence of organic coatings. One of ordinary skill in the art will understand that the structure of surface means the arrangement of the molecules of the various substances in relation to one another and in relation to the underlying metal layer.

The transition metal cations that are a necessary component of the treatment composition used according to the invention preferably are selected from the group consisting of nickel, cobalt, copper, iron, and manganese, with nickel, cobalt, and iron preferred and nickel most preferred. These cations may be provided by dissolving a corresponding elemental metal or an alloy in a precursor composition containing a sufficient amount of a suitable acid to cause the metal to dissolve with concomitant evolution of hydrogen gas. Usually, however, these cations are more conveniently and thus more preferably supplied in the form of an oxide or a salt of the metal. Inasmuch as many anions can have a deleterious effect on the operation of a treatment composition used according to the invention, it is preferred to utilize oxides, phosphates, nitrates, acetates, carbonates, and/or sulfates of one of the metals named, all of which compounds contain, or produce when dissolved, anions that are generally free of harmful effects if present, as the source(s) of these cations that are a required constituent of a treatment composition used according to the invention. The entire stoichiometric equivalent as any of these cations in any source material as dissolved in a composition according to the invention or in a precursor composition for it is to be considered as part of the total transition metal cations present, irrespective of the actual degree of ionization that may occur in the composition thus formed. Independently of their chemical nature, the total concentration of the transition metal cations dissolved in a working treatment composition according to the invention preferably is at least, with increasing preference in the order given, 0.4, 0.45, 0.50, 0.55, 0.6, 0.8, 1.0, 1.5, 2.0, 2.5, 3.0, 3.4, 3.8, 4.2 or 4.5 parts per thousand (hereinafter abbreviated as "ppt") and independently, primarily for reasons of economy, preferably is not more than, with increasing preference in the order given, 15.0, 12.0, 10.0, 8.0, 7.0, 6.7, 6.2, 5.7, 5.2, or 4.8 ppt.

The fluorine containing anions that are also a required constituent of a treatment composition used according to the invention preferably are selected from the group consisting of $F^-$, $BF_4^-$, $SiF_6^{-2}$, $TiF_6^{-2}$, $ZrF_6^{-2}$ and mixtures thereof, with the latter two more preferred and fluorotitanate most preferred. Such anions may be introduced into a treatment composition according to the invention as acids or salts, with the acids usually preferred for economy and because a net acidity of the compositions is preferable as considered further below. The entire stoichiometric equivalent as any of the above recited fluorometallate ions in any source material as dissolved in a composition according to the invention or a precursor composition for it is to be considered as part of the fluorometallate component, irrespective of the actual degree of ionization that may occur. Independently of their chemical nature, the total concentration of the fluorine containing anions dissolved in a working treatment composition according to the invention preferably is at least, with increasing preference in the order given, 0.90, 1.0, 1.5, 2.0, 2.5, 3.0, 3.5, 4.0, 4.5, 5.0, 5.25 g/L and independently, primarily for reasons of economy, preferably is not more than, with increasing preference in the order given, 12.0, 11.0, 10.5, 10.0, 9.5, 9.0, 8.5, 8.0, 7.5, 7.0, 6.5, 6.25, 6.0 g/L. Furthermore, independently of their actual concentrations, the concentrations of fluorometallate anions and transition metal cations preferably are such that the ratio between them is at least, with increasing preference in the order given, 0.50:1.0, 0.80:1.0, 1.20:1.0, 1.60:1.0, 1.80:1.0, 2.00:1.0, 2.10:1.0, 2.20:1.0, 2.30:1.0, 2.40:1.0, 2.45:1.0, 2.49:1.0, or 2.52:1.0 and independently preferably is not more than, with increasing preference in the order given, 10:1.0, 8.0:1.0, 6.0:1.0, 5.0:1.0, 4.5:1.0, 4.0:1.0, 3.5:1.0, 3.20:1.0, 3.00:1.0, 2.80:1.0, or 2.60:1.0.

No other constituents (except water and counterions) are necessary in a treatment composition used according to the invention, but normally at least one other substance to adjust the acidity is preferred. The pH value of a working treatment composition used according to the invention preferably is at least 1.5, 1.7, 1.9, 2.1, 2.2, 2.5, 2.60, 2.70, or 2.80 and independently preferably is not more than 3.8, 3.6, 3.5, 3.4 3.30, or 3.20. Too low a pH value will generally result in excessive attack on the substrate being treated, so that the surface is roughened, while too high a pH will reduce the efficiency of the treatment. Independently of pH, to the extent chemically possible, the Free Acid value of the treatment composition used in a process according to the invention, this Free Acid value being defined in "points" equal to the number of milliliters of 0.1 Normal NaOH required to bring the solution to pH 3.8, preferably is, with increasing preference in the order given, greater than 2, 3, 4 points and independently is less than 10, 9, 8, 7 points. This preferred combination of acidity conditions is readily achieved by one of ordinary skill in the art using inorganic bases such as, for example, alkali metal hydroxides and/or inorganic acids such as, for example, phosphorus oxyanion containing acids, provided that the acid or base selected does not interfere with the improved paint adhesion or corrosion resistance of the invention.

Zinc ions are likely to be present in any treatment composition according to the invention after it has been used to treat zinciferous metal substrates. The concentrations of zinc ions that develop under preferred operating conditions have little or no adverse effect on the efficacy of treatment. Sulfate ions also have not been observed to have any adverse effect, at least not within the preferred ranges. Phosphate anions are preferred as the counterion to the transition metal anion as they appear to contribute to the effectiveness of the treatment.

The treatment composition used in a process according to the invention preferably is maintained, during its period of contact with the metal substrate to be treated, at a temperature that is at least, with increasing preference in the order given, 60° C., 61° C., 62° C., 63° C., 64° C., 65° C., 66° C., 67° C., 68° C., 69° C., 70° C., 71° C., 72° C. 73° C., or 73.9° C. and independently preferably is not more than, with increasing preference in the order given, 90° C., 85° C., 83° C., 81° C., 79° C., 77° C., 75° C. Lower temperatures are unlikely to provide satisfactory changes in subsequent paint adhesion testing in an economically acceptable time, while higher temperatures at the very least impose an unnecessary higher energy cost for maintaining such temperatures.

The time of contact between a substrate surface being treated according to the invention and a treatment composition used in such a process preferably is sufficient to produce an attack on the chromium passivated zinc surface, which results in at least partial dissolution and redeposition of the passivate in a different structural arrangement. When other conditions of the process, including the chemical constitution of the treatment composition used, are within their preferred ranges, contact times preferably are at least, with increasing preference in the order given, 0.5, 1.0, 2.0, 3.0, 4.0, 5.0, 6.0, 7.0, 8.0, 9.0 or 10.0 seconds and independently, primarily for reasons of economy, preferably are not greater than, with increasing preference in the order given, 120, 100, 75, 50, 40, 30, 25, 22, 19, or 16 seconds.

When, as is normal, the use of at least part of a treatment composition is to be continued for a substantial period of time after the treatment composition has been prepared and used to treat its first areas of metallic surface, the volume of treatment composition removed by dragout eventually should be effectively replenished by additional treatment composition having the same chemical characteristics as the original treatment composition before it was contacted with any metal surface to be treated. A preferred replenisher for this purpose, denoted hereinafter as a "volume" replenisher, contains transition metal cations and fluorine-containing anions in the same proportions as for a freshly prepared working composition used according to the invention as described above, with the transition metal cations supplied by salts and the anions by their corresponding acids, and preferably no other ingredients except water.

However, the treatment process itself causes changes in the relative amounts of various components in the treatment composition, and for this reason it is preferred to use at least in part a distinct replenisher composition, denoted hereinafter as a "reaction" replenisher, that is not entirely the same in relative amounts of the ingredients as the original treatment composition. It has been found that such replenishment may be effectively accomplished by a concentrated replenisher composition that contains substantially more acidity and somewhat more transition metal in proportion to other ingredients of the composition than did the original treatment composition or a concentrate from which the original treatment composition was prepared by dilution with water only.

The replenisher compositions described immediately above are, in principle, most preferably added continuously, via a chemical metering pump, to the treatment composition at a rate which will maintain the most advantageous treatment properties in a process according to the invention. However, inasmuch as it is not always possible to predict the requirements for such replenishment with sufficient precision to permit actually continuous replenishment, it normally is practically preferred to set an operating range for at least one particular characteristic of the treatment composition used in a process according to the invention, to measure that characteristic frequently or most preferably continuously, to begin temporarily continuous addition of replenisher composition (s) only when the measured characteristic of the treatment composition passes one end of its set operating range for the process of the invention, and to discontinue such addition when the measured characteristic reaches the opposite end of its operating range. For controlling the process according to the invention by additions of the reaction replenisher, the most conveniently measured and otherwise generally suitable characteristic of a treatment composition has been found to be free acidity, while measurements of the transition metal cation and/or of the fluorometallate anion contents of the treatment composition have been found to be more suitable for controlling the additions of the volume replenisher.

A process according to the invention preferably is used as part of an overall process sequence including other steps that may be conventional in themselves. In particular, thorough cleaning of a surface to be treated according to the invention, before contacting this surface with the treatment liquid is desirable. A cleaning that frees the surface to be treated from oils, greases, waxes, corrosion products, and other foreign matter, is usually necessary before contacting the surface to be treated with a composition according to the invention, in order to obtain consistent results in a process according to the invention. Such cleaning may be accomplished by methods known in the art. It is preferred that the cleaning include some abrasion of the passivated surface, whether by brush rollers or particulate matter. The abrasion is desirably sufficient to activate the surface, that is, to increase the tendency for dissolution and redeposition, but does not remove the passivated surface. Thorough rinsing with water after any intermediate process step that includes contact between the metal and any material other than water and/or air, to prevent chemicals from contaminating the next treatment composition used, is also highly advantageous. A posttreatment, also known as a sealant or sealing treatment, after treatment according to this invention, with an aqueous solution containing both hexavalent and trivalent chromium and optionally but preferably also containing zinc cations and hydrofluoric acid is accomplished by ordinary means known to those of skill in the art. Surprisingly, this chromium containing post treatment does not interfere with subsequent organic coating, but tends to improve it. Alternatively, a hexavalent chromium free sealant or sealing treatment may be applied.

The Examples that follow are intended to explain the invention. It should be understood, however, that the invention is not limited to the specific details of the Examples.

EXAMPLES

Three groups of commercially available chromate passivated, hot dip galvanized (HDG) panels were evaluated for paintability. Each sample was nominally G90 HDG that had been chromate passivated (chemtreated) with passivation chemicals. Each group of samples had been chemtreated with a different commercially available chromate passivation, either Passivate A, B or C. Each sample was then treated as follows:

Parco Cleaner 1200, 10 sec. 160° F.
Water Rinse
One of Treatment Baths 1-6 (See Table 2), 10 sec. 160° F.
Water rinse
Parcolene 62, per manufacturer's Technical Process Bulletin 0350A Parco Cleaner 1200 is a high strength liquid alkaline cleaner available from Henkel Corporation, Madison Heights, Mich. Parcolene 62 is a partially reduced hexavalent chrome sealing rinse also available from Henkel Corporation. Each treatment bath was run with a range of acidities. The acidities were measured by titration with 0.1N NaOH with which those knowledgeable in treatment bath control are familiar.

The treatment baths were built with concentrates made from a commercially available nickel phosphate solution, a mixture of 92 wt. % of 25 wt. % fluorosilicic acid and 8 wt. % of 49 wt. % hydrofluoric acid, and nickel carbonate sufficient to raise the nickel content to the desired level and lower the free acid of the subsequently built treatment bath to just over 5.0 free acid. The free acid was adjusted in the working bath to the levels reported in Table 2.

The panels were dried and then painted with Valspar Primer Dynoprime PMY0302 and Fluropon 451A340 to a total nominal film build of 1.0 mil. Valspar Primer Dynoprime PMY0302 is a chromate containing primer paint commercially available Valspar, Kankakee, Ill. and Fluropon 451A340 is a Kynar™ containing topcoat also available from Valspar. The paint adhesion was evaluated for the panels with two tests, which are known in the art: the reverse impact test and the T-bend test.

Reverse Impact Test

Reverse Impact Tests were performed as in ASTM D2794. Each panel was cross hatched and then immersed in boiling water for 60 min. The panel was removed, dried and subjected to a reverse impact at 80 in-lb on the cross-hatch. Paint adhesion at the impact dimple (RIO) was determined by taping the dimple with Scotch No. 610 tape on the cross-hatch and quickly removing the tape in a direction perpendicular to the panel surface. The crosshatch was then rated for paint loss on a 1-4 scale, as described in Table 1.

T-bend Test

The 2T-bend test was carried out in accordance with ASTM D4145. Each sample panel was put into boiling water for 60 minutes and then evaluated with a 2T-bend for paint loss. The panels were taped with Scotch tape at the location of the bend, the tape was removed and the bend radii were inspected for paint loss. The paint loss was rated on a 1-4 scale as described in Table 1.

TABLE 1

| Paint Adhesion Rating Scale<br>Paint Adhesion Ratings | |
|---|---|
| No Pick Off | 4 |
| Light Pick Off | 3 |
| Medium Pick Off | 2 |
| Heavy Pick Off | 1 |

The results of the tests for each panel tested are given in Table 2.

TABLE 2

| | | | Passivate A | | Passivate B | | Passivate C | |
|---|---|---|---|---|---|---|---|---|
| Bath | FA | pH | RID | 2T | RID | 2T | RID | 2T |
| 1 | 2.0 | 3.31 | 4 | 2 | 4 | 4 | 4 | 2 |
| 2500 ppm Ni, | 3.0 | 3.20 | 4 | 2 | 4 | 4 | 4 | 4 |
| 3000 ppm F | 3.5 | 3.14 | 4 | 2 | 4 | 4 | 4 | 4 |
| | 4.0 | 3.09 | 4 | 4 | 4 | 4 | 4 | 4 |
| | 4.5 | 3.03 | 4 | 4 | 4 | 4 | 4 | 4 |
| | 5.0 | 3.98 | 4 | 4 | 4 | 4 | 4 | 4 |
| 2 | 2.0 | 3.31 | 4 | 2 | 4 | 4 | 4 | 2 |
| 3800 ppm Ni, | 2.5 | 3.25 | 4 | 4 | 4 | 4 | 4 | 3 |
| 3000 ppm F | 3.0 | 3.20 | 4 | 4 | 4 | 4 | 4 | 3 |
| | 4.0 | 3.09 | 4 | 4 | 4 | 4 | 4 | 4 |
| | 4.5 | 3.03 | 4 | 4 | 4 | 4 | 4 | 4 |
| 3 | 2.0 | 3.31 | 4 | 3 | 4 | 4 | 4 | 4 |
| 2500 ppm Ni, | 2.5 | 3.25 | 4 | 3 | 4 | 4 | 4 | 4 |
| 4500 ppm F | 3.0 | 3.20 | 4 | 3 | 4 | 4 | 4 | 4 |
| | 3.5 | 3.14 | 4 | 3 | 4 | 4 | 4 | 4 |
| | 4.0 | 3.09 | 4 | 3 | 4 | 4 | 4 | 4 |
| | 4.5 | 3.03 | 4 | 3 | 4 | 4 | 4 | 4 |
| | 5.0 | 2.98 | 4 | 4 | 4 | 4 | 4 | 4 |
| 4 | 2.0 | 3.31 | 4 | 2 | 4 | 4 | 4 | 1 |
| 3800 ppm Ni, | 3.0 | 3.20 | 4 | 3 | 4 | 4 | 4 | 2 |
| 4500 ppm F | 3.5 | 3.14 | 4 | 2 | 4 | 4 | 4 | 4 |
| | 4.0 | 3.09 | 4 | 2 | 4 | 4 | 4 | 4 |
| | 4.5 | 3.03 | 3 | 2 | 4 | 4 | 4 | 4 |
| | 5.0 | 2.98 | 4 | 2 | 4 | 4 | 4 | 4 |
| 5 | 2.0 | 3.31 | 4 | 3 | 4 | 4 | 4 | 2 |
| 2500 ppm Ni | 2.5 | 3.25 | 4 | 3 | 4 | 4 | 4 | 3 |
| 2000 ppm F | 3.0 | 3.20 | 4 | 3 | 4 | 4 | 4 | 4 |
| | 4.0 | 3.09 | 4 | 3 | 4 | 4 | 4 | 4 |
| | 4.5 | 3.03 | 4 | 4 | 4 | 4 | 4 | 4 |
| | 5.0 | 2.98 | 4 | 4 | 4 | 4 | 4 | 4 |
| 6 | 2.5 | 3.25 | 4 | 1 | 4 | 4 | 4 | 4 |
| 2500 ppm Ni, | 3.0 | 3.20 | 4 | 1 | 4 | 3 | 4 | 4 |
| 1500 ppm F | 3.5 | 3.14 | 4 | 2 | 4 | 4 | 4 | 4 |

TABLE 2-continued

| | | | Passivate A | | Passivate B | | Passivate C | |
|---|---|---|---|---|---|---|---|---|
| Bath | FA | pH | RID | 2T | RID | 2T | RID | 2T |
| | 4.0 | 3.09 | 4 | 3 | 4 | 4 | 4 | 4 |
| | 4.5 | 3.03 | 4 | 4 | 4 | 4 | 4 | 4 |
| | 5.0 | 2.98 | 4 | 4 | 4 | 4 | 4 | 4 |

FA means free acid;
RID means adhesion performance at the reverse impact dimple.

Five groups of commercially available chromate passivated, hot dip galvanized (HDG) panels were evaluated for paintability; two panels for each group were used. Each sample panel was nominally G90 HDG. Example 1 and 2, and Comparative Example 1 and 2, had been chromate passivated (chemtreated) with passivation chemicals. Example 1 and Comparative Example 1 had been chemtreated with the same commercially available chromate passivation, Passivate D. Example 2 and Comparative Example 2 had been chemtreated with the same commercially available chromate passivation, Passivate E.

Example 1 and 2 were treated as follows:

Parco Cleaner 1200, 10 sec. 160° F.

Water Rinse

Treatment Bath A, 10 sec. 160° F.

Water rinse

Parcolene 62, per manufacturer's Technical Process Bulletin 0350A

Parco Cleaner 1200 is a high strength liquid alkaline cleaner available from Henkel Corporation, Madison Heights, Mich. Parcolene 62 is a partially reduced hexavalent chrome sealing rinse also available from Henkel Corporation.

Comparative Example 1 and 2 were treated according to the treatment for Examples 1 and 2, except that no sealing rinse was applied.

Comparative Example 3 was not chromate passivated. Prior to paint application Comparative Example 3 was treated with Bonderite 1402W, a dry-in-place conversion coating, commercially available from Henkel Corporation.

Treatment Bath A, was built from a concentrate comprising a mixture of 6.6 wt. % fluorosilicic acid and 1.2 wt. % hydrofluoric acid, and sufficient nickel phosphate and nickel carbonate to produce a nickel content of 1.1 parts per thousand in a 5 vol. % working bath. The free acid of the treatment bath was adjusted to 5.0 free acid.

The panels were dried and then painted with Valspar Primer Dynoprime PMY0302 and Fluropon 451A340 to a total nominal film build of 1.0 mil. Valspar Primer Dynoprime PMY0302 is a chromate containing primer paint commercially available Valspar, Kankakee, Ill. and Fluropon 451A340 is a Kynar™ containing topcoat also available from Valspar.

3T-bend Test

The 3T-bend test was carried out in accordance with ASTM D4145. Each sample panel was put into boiling water for 60 minutes and then evaluated with a 3T-bend for paint loss. The panels were taped with Scotch tape at the location of the bend, the tape was removed and the bend radii were inspected for paint loss. The paint loss was rated on a 1-5 scale as described in Table 3. The results of the tests for each panel tested are given in Table 4.

TABLE 3

| Paint Adhesion Rating Scale<br>Paint Adhesion Ratings | |
|---|---|
| No Pick Off | 5 |
| Minute Amount of Pick Off | 4 |
| Light Pick Off | 3 |
| Medium Pick Off | 2 |
| Heavy Pick Off | 1 |

TABLE 4

| | Passivation | Treatment Bath | Sealing Rinse | Boil Water Rating at 3T |
|---|---|---|---|---|
| Example | | | | |
| 1 | D | A | P 62 | 4 |
| | D | A | P 62 | 4 |
| 2 | E | A | P 62 | 5 |
| | E | A | P 62 | 5 |
| Comparative Example | | | | |
| 1 | D | A | None | 1 |
| | D | A | None | 1 |
| 2 | E | A | None | 3 |
| | E | A | None | 3 |
| 3 | Not Passivated | 1402 W | — | 5 |
| | Not Passivated | 1402 W | — | 5 |

Examples 1 and 2 showed almost no paint loss after the 3T-bend test. This paint adhesion performance was comparable to the paint adhesion on a non-chromate passivated substrate pretreated with a conventional conversion coating.

Although the invention has been described with reference to preferred embodiments, it is to be understood that variations and modifications may be resorted to as will be apparent to those skilled in the art. Such variations and modifications are to be considered within the purview and scope of the claims appended hereto.

What is claimed is:

1. A method of treating a zinc-galvanized metal surface, which has been chemically passivated, the treatment providing increased resistance to corrosion and improved adherence to a subsequently applied organic coating comprising:

a) contacting a chromium passivated, zinc-galvanized metal surface with a coating solution bath comprising:

1) from about 1 to about 10 parts per thousand, based on fluorine content, of an inorganic acid or ion that contains fluorine;

2) at least 0.5 parts per thousand, based on transition metal cation content, of an oxide and/or a salt of nickel; and 3) optionally, from about 0 to about 3.0 grams per liter of a polymer selected from the group consisting of polyacrylic acid, polymethacrylic acid, and C1 to C8 alkanol esters thereof;

wherein the pH of the solution is from about 2.0 to 3.6 and the temperature of the solution is at least 60° C.; and thereafter b) sealing the treated surface.

2. The method of claim 1 wherein the inorganic acid or ion that contains fluorine is selected from the group consisting of HF, $HBF_4$, $H_2$ $SiF_6$, $H_2$ $TiF_6$, $H_2$ $ZrF_6$, $F^-$, $BF_4^-$, $SiF_6^{-2}$, $TiF_6^{-2}$, $ZrF_6^{-2}$ and mixtures thereof.

3. The method of claim 2 wherein the inorganic acid or ion that contains fluorine is selected from the group consisting of HF, $H_2SiF_6$, $F^-$, $SiF_6^{-2}$ and mixtures thereof.

4. A method of claim 1 wherein anions of nickel salt are selected from the group consisting of carbonate, sulfate, phosphate, acetate, nitrate, $F^-$, $BF_4^-$, $SiF_6^{-2}$, $TiF_6^{-2}$, $ZrF_6^{-2}$ and mixtures thereof.

5. The method of claim 4 wherein anions of the nickel salt are carbonate and/or phosphate.

6. The method of claim 1 wherein the inorganic acid or ion that contains fluorine is present in an amount from about 1.3 to about 8 parts per thousand.

7. The method of claim 1 wherein the oxide and/or salt of nickel is present in an amount from about 0.5 to about 10 parts per thousand.

8. The method of claim 1 wherein the inorganic acid or ion that contains fluorine is present in an amount from about 1.5 to about 7 parts per thousand and the oxide and/or salt of nickel is present in an amount from about 0.5 to about 5 parts per thousand.

9. A method of treating an article, having at least one zinc-galvanized metal surface which has been chemically passivated, the treatment providing increased resistance to corrosion and improved adherence to a subsequently applied organic coating comprising:

a) cleaning a chromium passivated, zinc-galvanized metal surface of the article;

b) contacting the cleaned chromium passivated, zinc-galvanized metal surface with a coating solution bath comprising:

1) from about 1 to about 10 parts per thousand, based on fluorine content, of an inorganic acid or ion that contains fluorine;

2) at least 0.5 parts per thousand, based on transition metal cation content, of an oxide and/or a salt of nickel; and 3) optionally, from about 0 to about 3.0 grams per liter of a polymer selected from the group consisting of polyacrylic acid, polymethacrylic acid, and $C_1$ to $C_8$ alkanol esters thereof;

wherein the pH of the solution is from about 2.0 to 3.6 and the temperature of the solution is at least 60° C. for a sufficient time to form a coated article;

c) rinsing the coated article with water;

d) contacting the coated surface with a sealing rinse; and e) drying the coated sealed surface.

10. The method of treating an article of claim 9, wherein the cleaning step comprising physical abrasion of the chromium passivated, zinc-galvanized metal surface such that at least some chromium from the chromium passivation remains on the metal surface.

11. The method of treating an article of claim 9, wherein the pH of the solution is from about 2.4 to 3.5 and the temperature of the solution is about 60° C. to about 90° C.

12. The method of claim 9 wherein the inorganic acid or ion that contains fluorine is selected from the group consisting of HF, $H_2SiF_6$, $F^-$, $SiF_6^{-2}$ and mixtures thereof.

13. The method of claim 9 wherein anions of the nickel salt are carbonate and/or phosphate.

14. The method of claim 9 wherein the inorganic acid or ion that contains fluorine is present in an amount from about 1.5 to about 7 parts per thousand and the oxide and/or salt of nickel is present in an amount from about 0.5 to about 5 parts per thousand.

15. A method of treating a surface on a metal article, having at least one surface comprising an amorphous mixture of zinc phosphate, zinc chromate, chromic chromates, chromium phosphate, and chromium oxides, the treatment providing increased resistance to corrosion and improved adherence to a subsequently applied organic coating comprising:

a) contacting the metal article having at least one surface comprising an amorphous mixture of zinc phosphate, zinc chromate, chromic chromates, chromium phosphate, and chromium oxides with a coating solution bath comprising:

1) from about 1 to about 10 parts per thousand, based on fluorine content, of an inorganic acid or ion that contains fluorine;

2) at least 0.5 parts per thousand, based on transition metal cation content, of an oxide and/or a salt of nickel; and 3) optionally, from about 0 to about 3.0 grams per liter of a polymer selected from the group consisting of polyacrylic acid, polymethacrylic acid, and $C_1$ to $C_8$ alkanol esters thereof;

wherein the pH of the solution is from about 2.0 to 3.6 and the temperature of the solution is at least 60° C.;

b) sealing the treated surface; and c) optionally, painting the sealed treated surface.

16. The method of treating an article of claim 15, wherein the coating solution bath has a Free Acid value within a range of about 3 to about 9.

17. The method of claim 15 wherein the inorganic acid or ion that contains fluorine is selected from the group consisting of HF, $H_2SiF_6$, $F^-$, $SiF_6^{-2}$ and mixtures thereof.

18. The method of claim 15 wherein anions of the nickel salt are carbonate and/or phosphate.

19. The method of claim 15 wherein the inorganic acid or ion that contains fluorine is present in an amount from about 1.5 to about 7 parts per thousand and the oxide and/or salt of nickel is present in an amount from about 0.5 to about 5 parts per thousand.

* * * * *